US005947038A

United States Patent [19]

Smith

[11] Patent Number: 5,947,038

[45] **Date of Patent: *Sep. 7, 1999**

[54] SECURITY BOX APPARATUS

[76] Inventor: Jerry R. Smith, 5690 W. Rowland Ave., Littleton, Colo. 80123

[ * ] Notice: This patent is subject to a terminal disclaimer.

[21] Appl. No.: 08/669,088

[22] Filed: Jun. 24, 1996

Related U.S. Application Data

[63] Continuation-in-part of application No. 08/154,259, Nov. 18, 1993, Pat. No. 5,528,998.

[51] Int. Cl.[6] ..... E05G 1/00

[52] U.S. Cl. ..... 109/50; 109/29; 109/45; 70/63; 40/202

[58] Field of Search ..... 109/22–25, 29, 109/33, 34, 45, 50–52, 54; 70/57, 58, 63, 150–162, 312, 315, 456 R; 220/343, 476, 480; 206/37.1, 335; 224/517, 557; 40/200–202, 209

[56] References Cited

U.S. PATENT DOCUMENTS

| | | | |
|---|---|---|---|
| 1,573,113 | 2/1926 | Irie | 40/209 |
| 2,819,692 | 1/1958 | Johnson et al. | 109/50 |
| 2,921,395 | 1/1960 | Fishman | 40/209 |
| 3,204,436 | 9/1965 | Nemsky | 70/63 |
| 3,312,010 | 4/1967 | Bartolone | 40/209 |
| 3,340,640 | 9/1967 | Savage | 40/209 |
| 3,683,827 | 8/1972 | Enright | 109/50 |
| 3,702,510 | 11/1972 | Genyk et al. | 40/209 |
| 3,867,823 | 2/1975 | Waltower | 70/63 X |
| 3,893,313 | 7/1975 | Kobayashi | 70/63 |
| 3,988,909 | 11/1976 | Catapano | 70/63 |
| 4,043,279 | 8/1977 | Padgett | 109/50 |
| 4,182,062 | 1/1980 | Krokos et al. | 40/209 |
| 4,249,469 | 2/1981 | Craske | 109/50 X |
| 4,474,116 | 10/1984 | Castenada, Jr. et al. | 109/51 |
| 4,722,435 | 2/1988 | Mareels et al. | 109/25 X |
| 4,738,341 | 4/1988 | Asano | 190/101 |
| 4,926,762 | 5/1990 | Paul | 109/51 |
| 5,012,602 | 5/1991 | Storey | 40/202 X |
| 5,404,664 | 4/1995 | Brooks et al. | 40/202 |
| 5,456,443 | 10/1995 | Taaffe | 248/499 X |
| 5,528,998 | 6/1996 | Smith et al. | 70/63 X |

FOREIGN PATENT DOCUMENTS

| | | | |
|---|---|---|---|
| 661012 | 6/1987 | Austria | 40/209 |
| 682898 | 12/1993 | Austria | 40/209 |
| 2627497 | 12/1977 | Germany | 40/201 |
| 2266986 | 11/1993 | United Kingdom | 40/202 |

*Primary Examiner*—Suzanne Dino Barrett
*Attorney, Agent, or Firm*—Timothy J. Martin; Michael R. Henson

[57] ABSTRACT

Security box apparatus is adapted for use with a conventional license plate mounting structure of a vehicle which includes a plurality of spaced apart installation holes. The security box apparatus is adapted to affix a license plate thereto to secure a protected item and comprises a housing member, a door, a locking structure and a license plate mounting assembly. The housing member is provided with a plurality of anchoring holes alignable with the installation holes so that a mounting fastener may extend through these holes to securely fasten the housing member to the license plate mounting structure. A recess is formed in the housing member and the door is sized and adapted to be received in this recess to enclose the interior and the protected item. The door is movable between a closed position wherein access to the interior is prevented and an opened position wherein access to the protected item is permitted. The locking structure has a secured state to latch the door to the recess in the closed position and a non-secured state whereby the door is movable from the closed position to the opened position. The license plate mounting assembly is disposed on the housing member and is for attaching the license plate to the housing member in a mounted position wherein the license plate conceals the door from view.

11 Claims, 8 Drawing Sheets

SECURITY BOX APPARATUS

The present application is a continuation-in-part of my U.S. patent application Ser. No. 08/154,259, filed Nov. 18, 1993 and entitled LOCK BOX APPARATUS, now U.S. Pat. No. 5,528,998 issued Jun. 25, 1996.

FIELD OF INVENTION

The present invention is broadly directed to a security box apparatus which is adapted for use in securely storing an item to be protected. The present invention is more specifically concerned with a security box apparatus which is adapted for use with a recess formed in a support structure, such as a door, wall or the like, in order to securely retain a protectable item. More specifically, though, the present invention is directed to a security box apparatus which may be mounted in a concealed fashion onto the conventional license plate mounting structure of a motor vehicle to securely house a protected item, such as a spare car key.

BACKGROUND OF THE INVENTION

Security has long been a concern for persons wishing to prevent theft of their belongings. As early as 4,000 years ago, ancient Egyptians were known to use wooden pin-tumbler type locks to secure the doors to their residences. Even today, practically everyone who lives in a residential dwelling and/or operates a motor vehicle is concerned with the security of themselves and their property. The fear of having one's personal property stolen has been exacerbated in recent years, and this is due in part to the escalation of crime in many areas. Both automobile manufacturers and home security companies have attempted to combat increased theft by developing a variety of security systems.

Residential dwellers will often lock access doors to their homes while the home is unoccupied or during nighttime hours. In addition, it is typical that motorists will lock the doors of their vehicles when the vehicle is either unattended or in an unsecured place.

Sometimes the owner's best efforts to avoid theft of his/her property causes the owner to become inadvertently locked out of his/her own home or car. For example, a problem arises when the doors on either a home or a vehicle can be locked without using a key. Unfortunately, these types of locking doors can potentially lock a person out of his/her own home or vehicle if the person is not carrying the appropriate key. This may occur, for instance, when a motorist manually manipulates the locks on the car doors into a locked state and then inadvertently closes the locked doors while leaving the keys in the ignition or passenger compartment.

Locking oneself out of one's home or vehicle can be an extremely frustrating experience because it is inconvenient, time consuming and costly. One option of gaining entry into the property is to break a window to provide access. Another option would be to call a locksmith, provided a telephone is within a reasonable proximity, so that entry into the premises can be gained without incurring damage. Nonetheless, the cost during such circumstances are surprisingly high. Figures reported by the American Automobile Association indicate that during 1992 in excess of $400 million was spent to assist motorists who had locked themselves out of their vehicles.

To resolve this long standing problem of locking oneself out of one's vehicle, the most cautious motorist sometimes carries a spare door key in a wallet or a purse. Occasionally, the motorist will place the spare key in a metal or plastic container that has a magnet which can secure the container to a portion of the vehicle. However, while the vehicle is moving, jarring forces and vibration can cause this container to become dislodged and lost during transit. Another method of addressing the problem of locking oneself out of one's vehicle is by using a keyless entry whereby the motorist enters an appropriate code to electronically release the door locks. However, such a method can be quite costly and typically requires the manufacturer to install the key pad device at the factory while the vehicle is being assembled.

To avoid locking oneself out of one's home or other structure, a homeowner might hide a spare key somewhere around the exterior of the property. Sometimes, however, an absent minded homeowner forgets where the spare key is hidden. On the other hand, it is possible that a burglar would discover the whereabouts of the key and gain access into the locked premises. Hiding a key in a hollow plastic rock is a well-known technique. Unfortunately, due its wide spread usage, it does not always fool a burglar.

Therefore, a long felt need exists to provide a convenient, yet inexpensive way for one who has been inadvertently locked out of premises, such as a home or a vehicle, to gain access thereinto. A convenient approach to satisfying this need is to provide a spare key which is maintained in a secure, yet easily accessible location outside of one's property. It would be advantageous if such a key could be secured into a security box which is fixably mounted to a recess in the home or vehicle in order to prevent theft of the security box apparatus and the key. It would be further advantageous for such a security box apparatus to be relatively compact so that it can be hidden from view of the general public. The present invention is directed to meeting these needs, among others.

SUMMARY OF INVENTION

It is an object of the present invention to provide a new and useful security box apparatus which is adapted for use with a recess formed in a support structure to secure a protected item, such as a key, therein.

Another object of the present invention is to provide a security box apparatus that is adapted for use with a motor vehicle, specifically a conventional license plate mounting structure of a motor vehicle, to securely house a spare automobile key.

A further object of the present invention is to provide a security box apparatus which is sized to be mounted behind a license plate of a motor vehicle and hidden from view of the general public.

Still a further object of the present invention is to provide a security box apparatus which may be directly mounted onto the existing license plate mounting structure of a motor vehicle.

Yet another object of the present invention is to provide a security box apparatus adapted for use in mounting to a recess formed in a support structure, which security box apparatus is particularly constructed in such a manner to deter a perpetrator from breaching the security thereof in order to access a protected item contained therein.

Still a further object of the present invention is to provide a new and useful security box apparatus which has a unique locking assembly associated therewith.

The present invention is broadly directed to a security box apparatus which may be used, preferably in conjunction with a vehicle, for the safekeeping of a protected item. Broadly, the security box apparatus of the present invention comprises a housing structure associated with a vehicle, a door, and a locking assembly. A recess is formed in the housing structure to define a housing interior which is adapted to receive the protected item, and this recess has a selected geometric configuration, preferably rectangular. The door is adapted to be nestably received in this recess to enclose the interior and the protected item. The door is movable from a closed position wherein the interior is enclosed, thereby preventing access to the protected item, to an opened position wherein the interior is exposed, thereby permitting access to the protected item. The locking assembly is associated with the door and has a secured state wherein the door is latched to the recess in the closed position and an unsecured state whereby the door is movable between the closed and opened positions.

The recess may be formed in either a body portion or a bumper of the vehicle, whereby either the body portion or the bumper would define the housing structure. Alternatively, the recess can be formed in a housing member that is adapted to be secured to the vehicle or a body component thereof.

Wherein the recess is formed in a housing member adapted to be secured to the vehicle, it is preferred that the recess be rectangular in configuration and include a plurality of spaced apart anchoring holes extending therethrough. These anchoring holes are alignable with a plurality of installation holes formed in the body component so that a mounting fastener may extend through aligned ones of the anchoring holes and the installation holes thereby to fasten the housing member to the body component. When the door is in the closed position, then, it operates to conceal the mounting fasteners and prevent access thereto. The door is configured to be nestably received with the recess when the door is in the closed position.

The recess is defined by a surrounding sidewall which includes an elongated slot formed therein. The locking assembly includes a latching member which is operative when the locking assembly is in the secured state to protrude outwardly from a surface of the door to engage this elongated slot, thereby retaining the door in the closed position. The latching member is further operative when the latching assembly is in the unsecured state to recede into the housing interior and become disengaged from the elongated slot, thereby permitting the door to be moved from the closed to the opened position. It is preferred that the latching member operates with an array of rotatable locking elements so that when this array of locking elements is rotated into a selected combination of locking element positions, the latching member is enabled to reciprocally slide thereby enabling the locking assembly to move between the secured state and the unsecured state. Alternately, when the array of locking elements is rotated into a random combination of locking element positions different from the selected combination of locking element positions, the latching member is prevented from reciprocally sliding, thereby rendering the locking assembly in the secured state.

The security box of the present invention may include a frangible ampule which contains defiling fluid. This ampule is preferably disposed within the housing interior proximate to the protected items so that, upon breaching security of the security box apparatus, the ampule fractures thereby releasing the defiling fluid onto the protected item and rendering the protected item unusable.

In another embodiment of the present invention, the security box apparatus is adapted for use with a conventional license plate mounting structure of a motor vehicle which includes a plurality of spaced apart installation holes. The security box apparatus of this embodiment is used both for securing a protected item and for affixing a license plate thereto. The security box apparatus includes a door and a locking assembly as discussed above.

Here, the housing member is provided with a plurality of spaced apart anchoring holes extending therethrough. These anchoring holes are alignable with the installation holes so that a mounting fastener may extend through aligned ones of the anchoring holes and the installation holes to securely fasten the housing member to the license plate mounting structure. The housing member is formed to include the recess as discussed above.

A license plate mounting assembly is also included which is disposed on the housing member, and which is preferably removably disposed on the housing member. This license plate mounting assembly is for attaching the license plate to the housing member in a mounted state wherein the license plate conceals the door from view. The license plate mounting assembly is operative to be removably disposed within the recess, and the recess is sized to accommodate both the license plate mounting assembly and the door in a close fitted relationship whereby when the door is in the closed position, the door prohibits removal of the license plate mounting assembly from the recess.

The license plate mounting assembly preferably includes a first piece which is mounted to the housing member and a second piece which is removably connectable to the first piece. The license plate is attachable to the second piece. A channel may be formed in the license plate mounting assembly which is adapted to slidably and interlockingly engage a rail formed in the recess so that the mounting assembly may be inserted into and removed from the recess. A hinge structure is included for removably connecting the first and second pieces so that the license plate and the second piece are operative to pivot into the mounted position relative to the first piece.

The second piece is formed to include a pair of confined cavities which are positioned to align with corresponding securement holes in the license plate, there being a fastening assembly associated with each of these cavities and securement holes. The fastening assembly preferably includes a pair of cooperative fasteners in the form of a nut and bolt, with each nut sized to fit within a respective one of the cavities and each bolt sized and adapted to extend through aligned ones of the cavities and the securement holes to threadedly engage a respective nut. As such, the license plate may be attached to the second piece.

It is preferred that each cavity is enlarged relative to its respective said nut so that the bolt is prevented from rotating relative to its associated nut within the cavity. With this construction, a plurality of biasing holes may be formed in the second piece, with there being a biasing hole associated with and intersecting each cavity. The fastening assembly further includes a locking pin which is sized to be inserted into an associated biasing hole, and this locking pin operates to engage the nut and to prohibit the nut from freely rotating within its respective cavity, thereby permitting the bolt to rotate in threaded engagement relative to its associated nut to attach the license plate to the second piece. The biasing holes are preferably positioned along the second piece in such a manner that they are inaccessible when the license plate and the second piece are pivoted into the mounted position.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention broadly concerns a security box apparatus that is adapted for mounting into a recess formed in a housing structure to ensure the safekeeping of a protectable item therein. The ensuing description of the exemplary embodiments of the security box apparatus according to the present invention primarily relates to a security box apparatus adapted for use with the conventional license plate mounting structure of a motor vehicle. One of ordinary skill in the art would appreciate, though, that the present invention has other applications aside from those described herein because it can be used in conjunction with other housing structures, such as a door, a wall and the like.

Moreover, the security box apparatus of the present invention can be used to secure other items, particularly those which are relatively small, such as a ring, a rare coin or other valuables. The present invention is particularly useful where the item or items to be protected are small and where it would be desirable to mount the security box apparatus to a housing structure.

Figure 1:
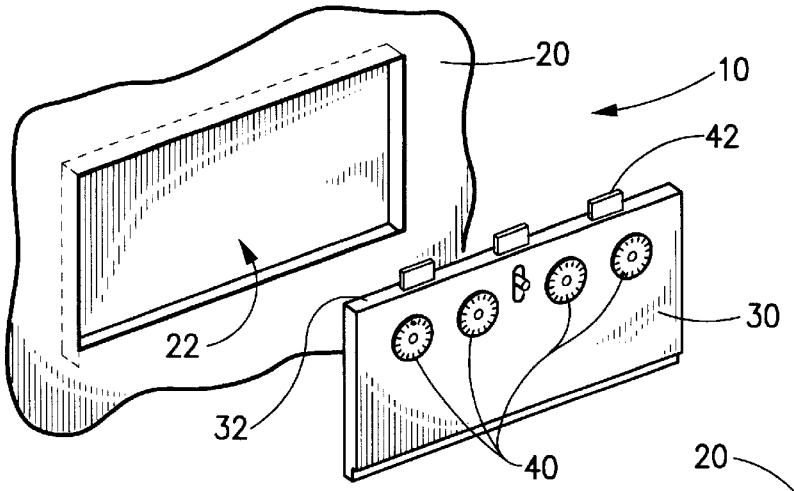
FIG. 1 is an exploded perspective view of the security box apparatus according to a first exemplary embodiment of the present invention and specifically showing a housing structure provided with a recess in which the door component of the security box apparatus may be securely latched.
Figure 2:
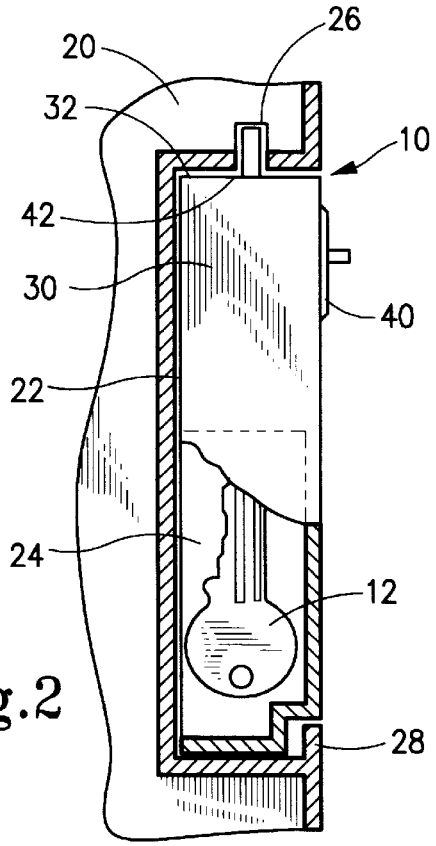
FIG. 2 is a side view in elevation and in partial cross-section of the security box apparatus of FIG. 1 with the door shown in the closed position and the locking assembly shown in a secured state.

In its broadest form, the security box apparatus of the present invention comprises a housing structure, a door, and a locking assembly for securing the door to the housing structure in a secured state. A first exemplary embodiment of the security box apparatus 10 according to the present invention is generally shown in FIGS. 1–2. Security box apparatus 10 includes a housing structure 20 having a recess 22 formed therein and a door 30 which is adapted to be received in recess 22. Recess 22 is formed to have a selected geometric configuration to define a housing interior 24 which is sized to receive door 30 as well as a protectable item, such as key 12 as shown in FIG. 2. Of course, it should be readily understood that other types of items to be protected, such as jewelry, important papers and the like, could also be stored in security box apparatus 10 with the only limitation being the size of housing interior 24 for storing these items.

Security box apparatus 10 also includes a locking assembly 40, as shown in FIGS. 1 and 2. Locking assembly 40 is associated with door 30 and recess 22 and has a secured state, as shown in FIG. 2, wherein door 30 is latched to recess 22 in a closed position. When in the secured state, door 30 is latched to housing structure 20 in a close fitted engagement by virtue of a latching member 42 which protrudes outwardly from a surface 32 of door 30 to engage an elongated slot 26 formed in housing structure 20. Attachment of door 30 into housing structure 20 is also accomplished by a lip 28 formed in housing structure 20 which cooperatively engages a base region of door 30.

The specifics of the locking assembly 40 of security box apparatus 10 will be discussed in greater detail below, but it should be appreciated by the ordinarily skilled artisan that a variety of locking assemblies could be used in conjunction with door 30 in order to securely retain door 30 in a secured state within housing structure 20. Accordingly, the locking assembly 40 associated with the security box apparatus of the present invention should not be unnecessarily limited to that embodiment which is described herein.

Moreover, housing structure 20 can be a variety of support structures which may be provided with a recess that is adapted to securely receive a lockable door. Such structures might include, but should not be limited to, doors, walls, table tops and the like. Thus, while the security box apparatus of the present invention will be primarily described later with reference to a motor vehicle, other types of applications are certainly contemplated.

Figure 3:
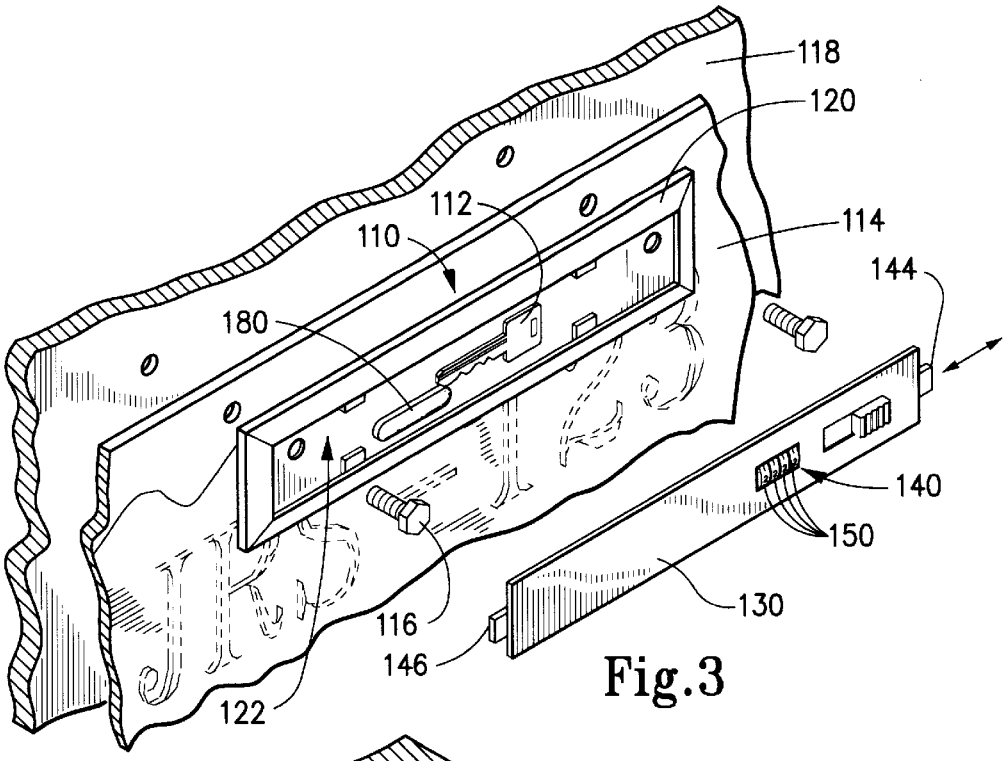
FIG. 3 is an exploded perspective view of a second exemplary embodiment of the security box apparatus of the present invention shown mountable to a license plate of a motor vehicle.

A second exemplary embodiment of a security box apparatus 110 is shown in FIG. 3. As with the first exemplary embodiment, security box apparatus 110 comprises a housing structure 120 that is provided with a recess 122, a door 130 and a locking assembly 140. It is intended that this second exemplary embodiment be mounted over a license plate 114 such that it is fully exposed into view of the general public.

For the second exemplary embodiment of security box apparatus 120, door 130 is completely detachable from housing structure 120. One of ordinary skill in the art would appreciate that a locking assembly 140 of this second exemplary embodiment of the present invention includes a conventional, slidable bolt element 144, a stationary bolt element 146 and an array of locking elements 150. The array of locking elements 150 are conventional lock cylinders and are rotatably mounted to door 130. A pair of mounting fasteners 116, the form of conventional bolts, are used to directly mount housing structure 120 to license plate 114 as well as a support surface 118.

Some vehicle manufacturers provide the motorist with a pair of keys. Typically, one key is for the ignition and the other key is for both the door locks and the trunk lock. To best utilize any of the herein discussed security box apparatus of the present invention, it is intended that the door/trunk key be the protected item within the security box apparatus. Then, the ignition key can be hidden in either the passenger compartment or the trunk if needed when the motorist is locked out of his/her vehicle.

Other vehicle manufacturers provide only a single key for ignition, door locks and truck. This could be inviting to a car thief having this information. It is then recommended that a frangible ampule 180, as shown in FIG. 3, containing a defiling fluid be disposed within the housing structure 120 proximate to a spare key 112 so that, upon breaching security of the security box apparatus, frangible ampule 180 fractures thereby releasing the defiling fluid onto the protected item 112 and rendering the protected item 112 unusable. An odoriferous fluid, glue or acid, are examples of the defiling fluids which might deter criminal actions of a car thief. Moreover, it is desirable that key 112 be constructed of a plastic material and the defiling fluid be a fast acting solvent which can quickly destroy the operability of key 112.

Figure 4:
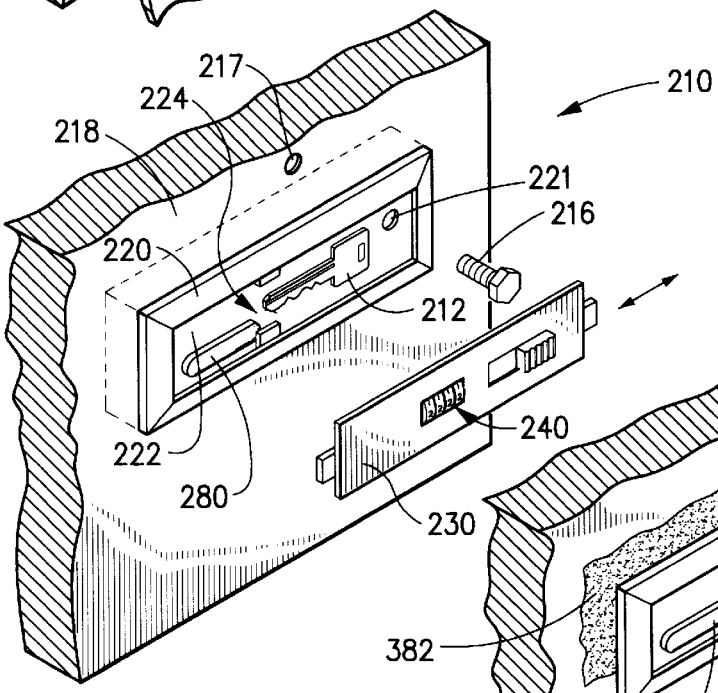
FIG. 4 is an exploded perspective view of a third exemplary embodiment of the security box apparatus of the present invention as shown adapted to be mounted directly to a support structure.

A third exemplary embodiment of a security box apparatus 210 is shown in FIG. 4 and comprises a housing structure 220, a door 230 and a locking assembly 240. Here again, housing structure 220 is provided with a recess 222 to define a housing interior 224 within which the protectable item 212 is securely stored for safekeeping. Support structure 218 has an installation hole 217 adapted to receive a mounting fastener 216 in a matable relationship to retain security box apparatus 210 onto support structure 218. It follows then, that housing structure 220 has one anchoring hole 221 extending therethrough and located such that mounting fastener 216 can extend through anchoring hole 221 and into installation hole 217 to install housing structure 220 onto support structure 218. Support structure 218, as discussed above, could be a conventional door, a wall or other structure which may be provided with a recess 222.

Figure 5:
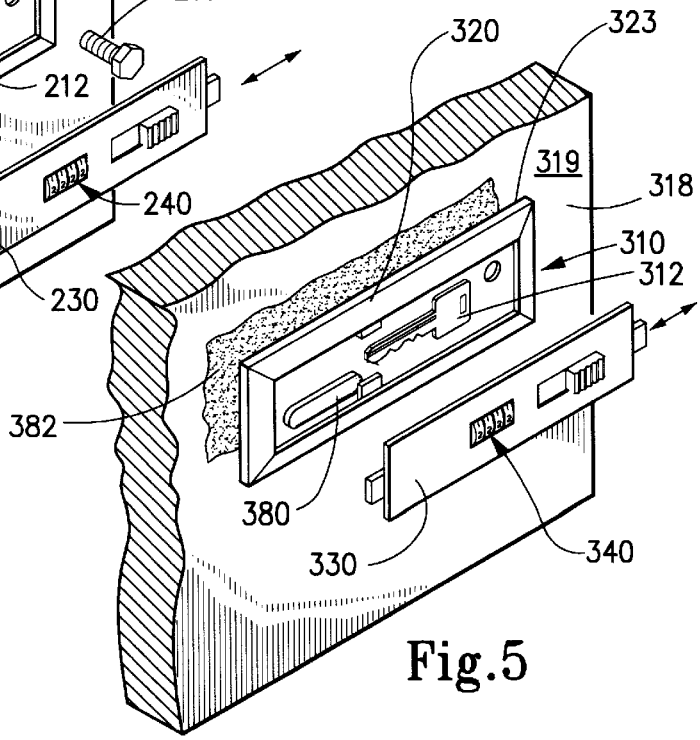
FIG. 5 is an exploded perspective view of a fourth exemplary embodiment of the security box apparatus of the present invention as shown adapted for mounting onto a support structure.
Figure 7:
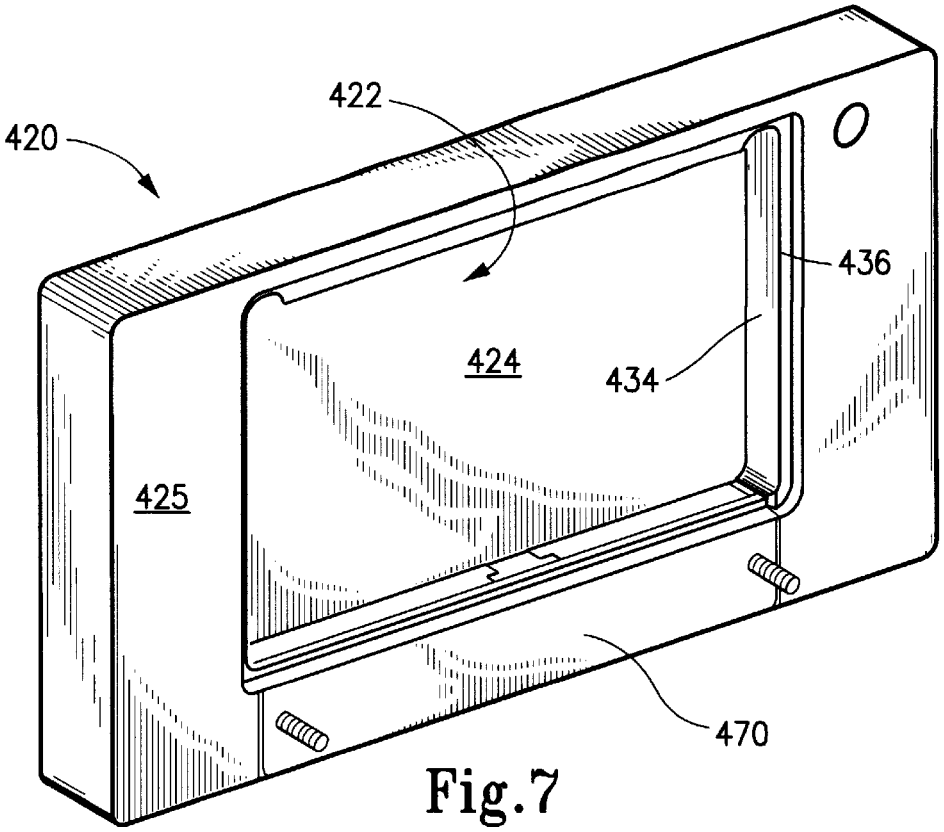
FIG. 7 is an exploded perspective view showing a preferred construction of the housing member associated with a fifth exemplary embodiment of the present invention, with a license plate mounting assembly disposed therein.
Figure 11:
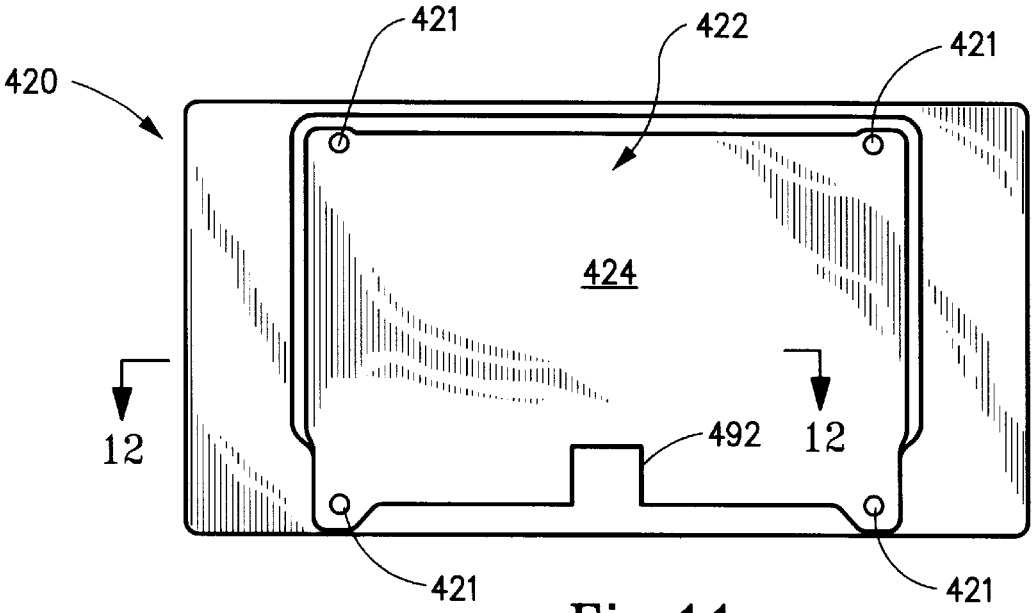
FIG. 11 is a front plan view of the housing member according to the fifth exemplary embodiment of the present invention.

A fourth exemplary embodiment of a security box apparatus 310 of the present invention is shown in FIG. 5 and comprises a housing structure 320, a door 330, and a locking assembly 340. Support structure 318 has a flattened mounting surface 319. Housing structure 320 has a flattened exterior surface 323 located such that housing structure 320 can be mounted onto support structure 318 by a layer of adhesive material 382. Adhesive material 382 can be two-sided tape, hook and loop fasteners, a magnet, or some other element capable of affixing housing structure 320 onto support structure 318.

Figure 6:
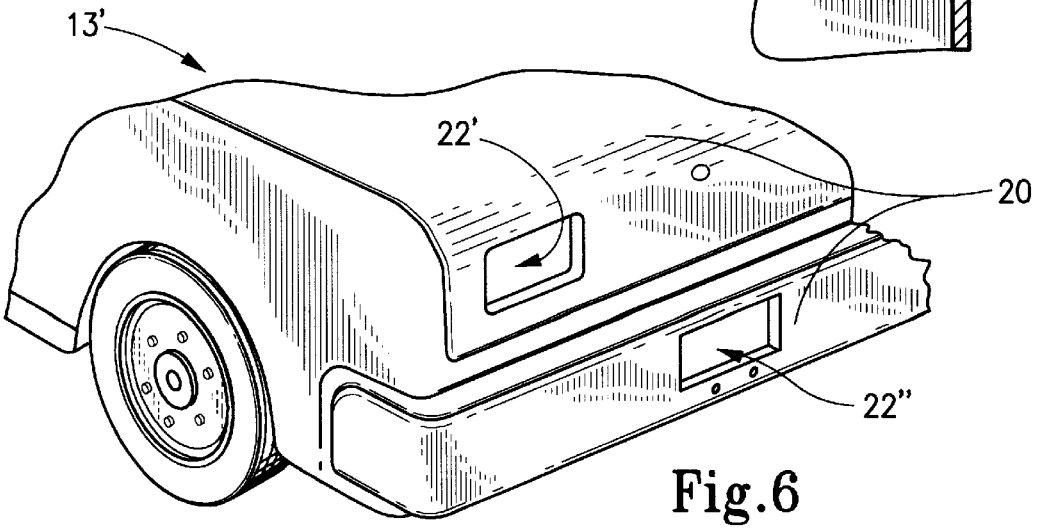
FIG. 6 is a partial perspective view illustrating two representative locations for the housing structure according to the first exemplary embodiment of the present invention, as defined by two different body portions of a conventional motor vehicle.

As discussed above with reference to the first exemplary embodiment of the security box apparatus 10 of the present invention, recess 22 can be formed in a variety of different types of housing structures 20. Of particularly applicability to the present invention, it is preferred that housing structure 20 be associated with a motor vehicle 13, as shown in FIG. 6, so that recess 22' is formed in a body portion of the vehicle 13, such as the trunk, or a recess, such as recess 22" can be formed in another component of the vehicle, such as the vehicle's bumper. Of course, FIG. 6 is only illustrative of a few representative locations which one may find a recess for the security box apparatus of the present invention, and other locations within the vehicle 13 are certainly contemplated.

A fifth exemplary embodiment for a security box apparatus 410 of the present invention is best explained with reference to FIGS. 7–20. Here, it should be appreciated that the security box apparatus 410 is adapted for use with a conventional license plate mounting structure of a motor vehicle. With this fifth embodiment, security box apparatus 410 is adapted to have a license plate 414 affixed thereto and is used for securing a protected item as discussed above with reference to the other embodiments of the present invention. Security box apparatus 410 includes a housing member 420, a door 430, a locking assembly 440 and a license plate mounting assembly 470.

Figure 8:
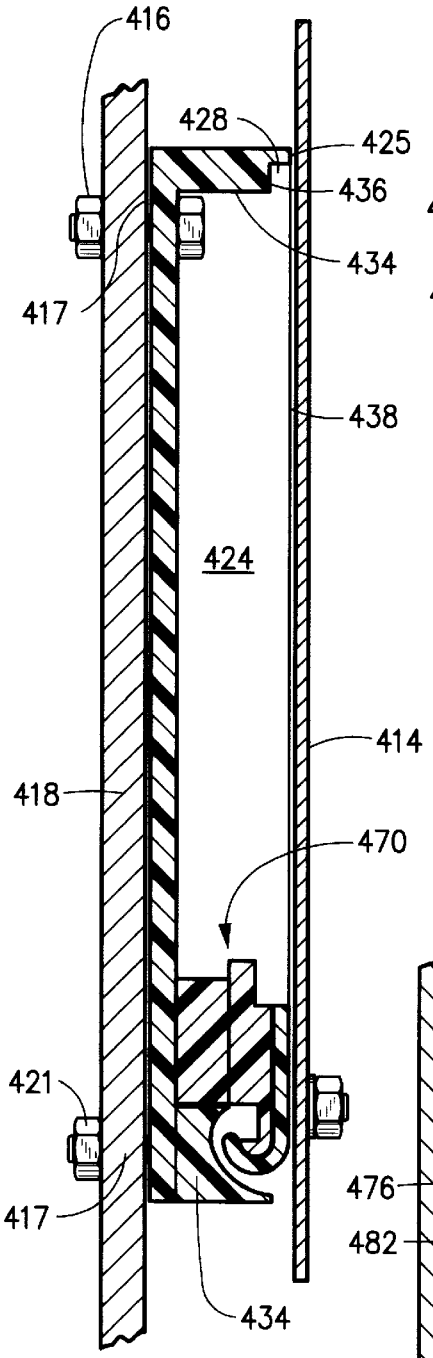
FIG. 8 is a side view in elevation and in cross-section of the security box apparatus according to the fifth exemplary embodiment of the present invention (without the door component thereof) with a license plate affixed thereto and shown mounted to a conventional license plate mounting structure.

A preferred construction for housing member 420 may best be appreciated with reference to FIGS. 7, 8, 11 and 12. Housing member 420 is provided with a plurality of spaced-apart anchoring holes 421 which extend therethrough and these anchoring holes 421 are alignable with installation holes 417 of a conventional license plate mounting structure so that mounting fasteners 416 may extend through aligned ones of the anchoring holes 421 and the installation holes 417 to securely fasten housing member 420 to the license plate mounting structure, as best shown in FIG. 8. Housing member 420 has a recess 422 formed therein which is of a selected geometric configuration, shown as generally rectangular in the figures. Recess 422, thus, defines a housing interior 424 which is adapted to receive a protected item (not shown).

Again, door 430 is sized and adapted to be received in recess 422 of housing member 420 so that the protected item is securely received within housing interior 424. Door 430, as discussed above, is movable between a closed position wherein the housing interior 424 is enclosed thereby preventing access to both protected item and mounting fasteners 416, and an opened position wherein interior 424 is exposed thereby permitting access to the protected item and mounting fasteners 416. To this end, and as best shown with reference to FIG. 8, sidewall 434 terminates in a ledge 436 upon which a peripheral lip 428 of door 430 rests when door 430 is in the closed position. As such, an outer surface 438 of door 430 is flush with the outer surface 425 associated with housing member 420.

Figure 9:
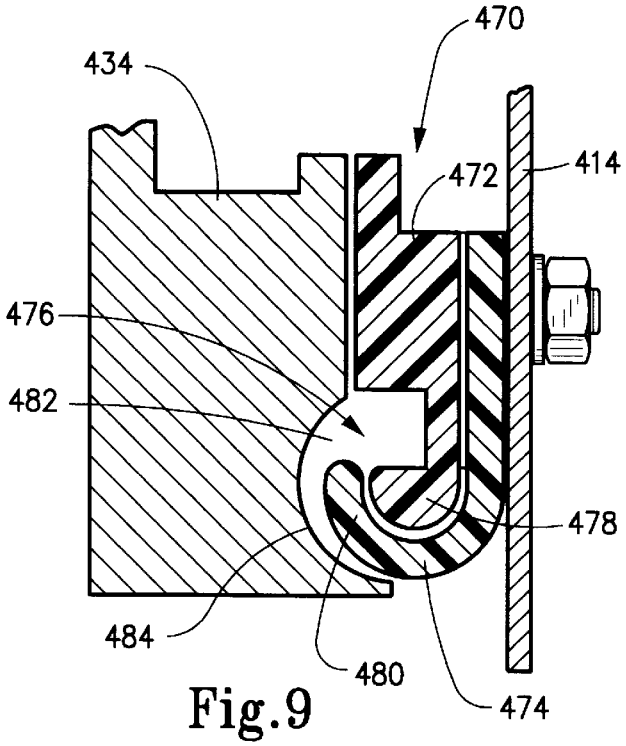
FIG. 9 is an enlarged, cross-sectional side view of the license plate mounting assembly of FIG. 8 with the license plate shown in a mounted position.
Figure 10:
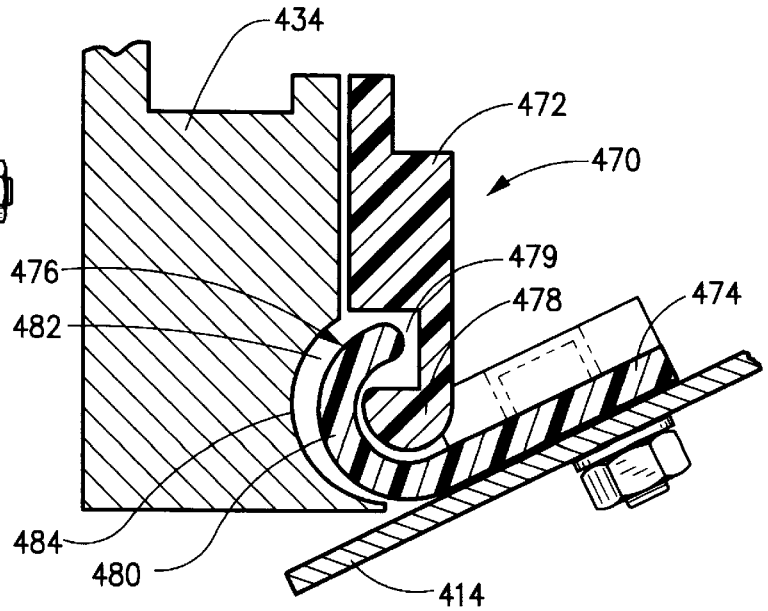
FIG. 10 is an enlarged, cross-sectional side view of the license plate mounting assembly of FIG. 8 as shown in a pivoted position.

An added feature to the fifth embodiment of the security box apparatus 410 of the present invention is the incorporation of a license plate mounting assembly 470 which is disposed on housing member 420. License plate mounting assembly 470 is used to attach license plate 414 to housing member 420 in a mounted position wherein the license plate 414 conceals door 430 from view, as best shown in FIGS. 8 and 9. This is a very useful feature of the present invention a thief is unlikely, without closely inspecting security box apparatus 410, to realize that a protected item is housed behind license plate 414.

It is preferred that license plate mounting assembly 470 be removably and slidably disposed within recess 422 and that recess 422 be sized to accommodate both license plate mounting assembly 470 and door 430 in a close fitted relationship so that when door 430 is in the closed position, door 430 prohibits removal of license plate mounting assembly 470 from recess 422. To accomplish this, license plate mounting assembly 470 includes two interlocking mounting pieces which are removably connectable together. A first piece 472 is slidably disposed within the recess 422 of housing member 420 and a second piece 474 is removably connected to first piece 472 by a hinge structure 476. License plate 414 is affixed to second piece 474 so that both license plate 414 and second piece 474 may be pivoted relative to first piece 472 to position license plate 414 in the mounted position shown in FIGS. 8 and 9. To accomplish this pivotal movement, hinge structure 476 is formed by the interlocking engagement of an elongated arcuate lip 478 formed on an edge of first piece 472 and a larger, cooperative lip 480 formed on an edge of second piece 474. As such, enlarged lip 480 is configured to pivot within a confined pivoting channel 482 that is defined by an arcuate groove 484 formed in sidewall 434 and the smaller, yet arcuate contour of lip 478. Lip 480 is confined for movement within this arcuate passageway 482 so that second piece 474 is inhibited from becoming disengaged from first piece 472.

Figure 12:
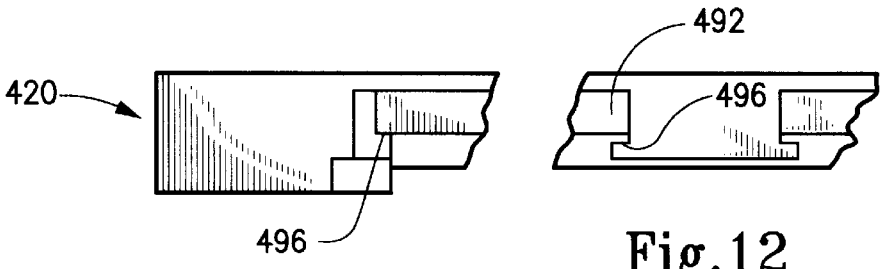
FIG. 12 is an elevational view, partially broken away, about lines 12—12 in FIG. 11.

As mentioned above, it is preferred that license mounting assembly 470, and specifically first piece 472 thereof, be slidably disposed within housing member 420. To accomplish this, first piece 472 is constructed to have a channel 490 formed therein which is sized and adapted to slidably engage an upstanding rail 492 formed on housing structure 420, and specifically within recess 422. Channel 490 includes a pair of oppositely disposed slots 494 and 495 within which an overhang 496 of rail 492 is slidably received in a close-fitted mated engagement, as shown in FIG. 12. While channel 490 and rail 492 are shown in the figures to be centrally located within their respective pieces, it should be understood that this need not be the case. For example, a plurality of cooperative rail and channel constructions could be incorporated, as well as other ways to slidably engage first piece 472 within recess 422. Regardless of the particular construction adopted, it is desirous that license plate mounting assembly 470 be constructed in such a manner that it is retained in a close-fitted mated relationship with door 430 when door 430 is in the closed state to prohibit removal thereof when the door is latched securely.

Figure 13:
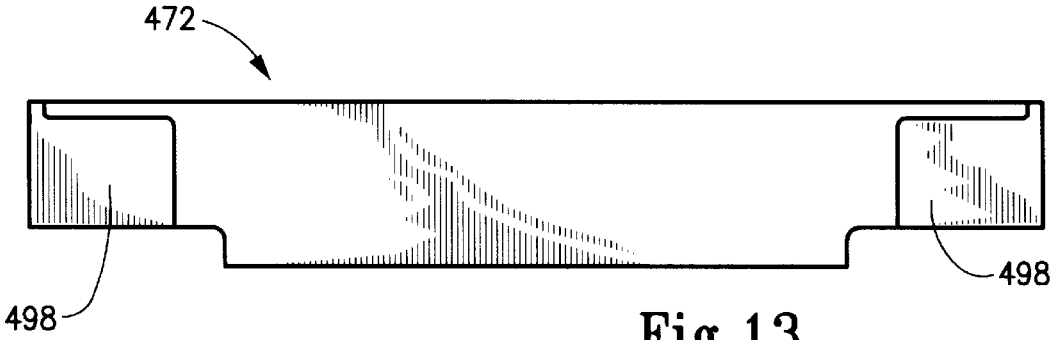
FIG. 13 is a front plan view of the first mounting piece which comprises a component of the license plate mounting assembly according to the fifth exemplary embodiment of the present invention.
Figure 14:
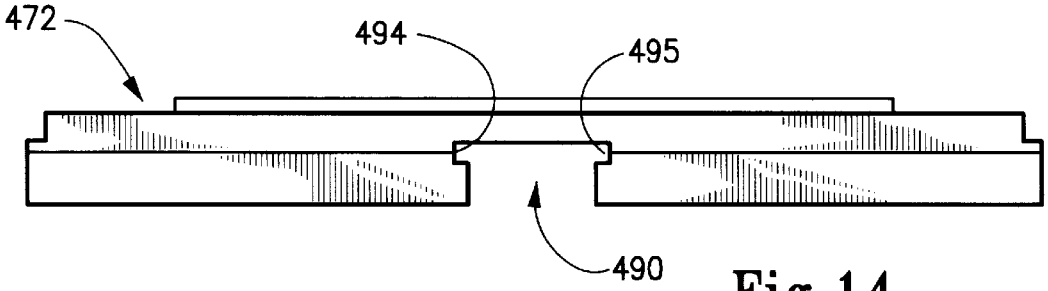
FIG. 14 is a top view in elevation of the first mounting piece shown in FIG. 13.
Figure 15:
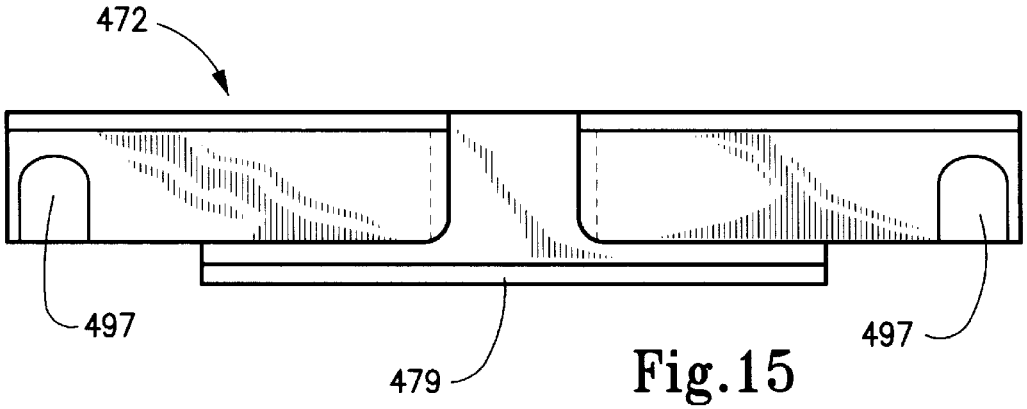
FIG. 15 is a rear plan view of the first mounting piece shown in FIG. 13.
Figure 16:
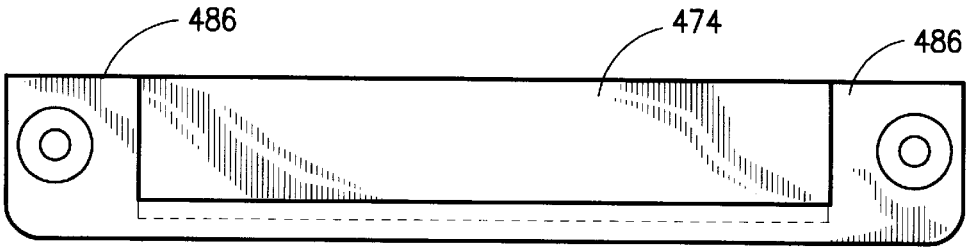
FIG. 16 is a front plan view of the second mounting piece which comprises a component of the license plate mounting assembly according to the fifth exemplary embodiment of the present invention.

As shown in FIGS. 13–15, first piece 472 is also provided with a pair of opposed rectangularly configured cut-outs 498 formed in an upper surface thereof and a pair of oppositely disposed arcuately configured indentations 497 formed in a lower surface thereof. Indentations 497 are included so that mounting fasteners 416 do not interfere with the first piece 472 when first piece 472 is slidably received within recess 422. Likewise, cut-outs 498 are provided on the upper surface of first piece 472 to provide seats for oppositely disposed feet 486 on second piece 474 when first piece 472 and second piece 474 are assembled together.

Another feature is incorporated into the security box apparatus 410 of the present invention in recognition that it is desirous to have a security box apparatus which is constructed in such a manner as to prevent theft of the license plate 414 therefrom. In accordance with this objective, then, a unique fastening assembly 480 is associated with second piece 474 so that it is exceedingly difficult to physically remove license plate 414 from second piece 474 when license plate mounting assembly 470 and door 430 are secured within the recess 422 of housing member 420. Fastening assembly 480 is shown with reference to FIGS. 16 and 17 wherein it may be seen that second piece 474 includes a pair of cavities 482 formed within feet 486, there being one cavity 482 associated with each foot 486. Fastening assembly 480 includes a pair of cooperative fasteners 484 which are each in the form of a nut 488 and a bolt 489. Each nut 488 is sized to fit within a respective one of cavities 486 and each bolt 489 is sized and adapted to extend through aligned ones of cavities 486 and corresponding securement holes 485 formed in license plate 414 to threadedly engage a respective nut 488, thereby to attach license plate 414 to second piece 474.

Figure 17:
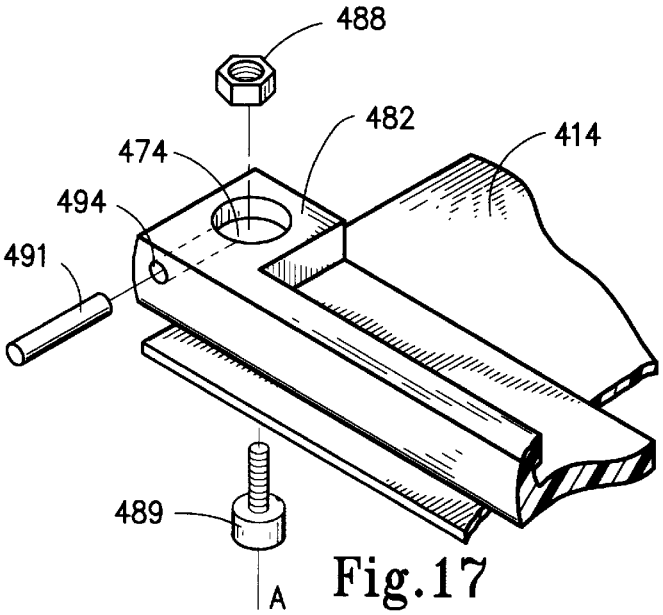
FIG. 17 is an exploded perspective view, in partial cross-section, showing a fastening assembly which may be used to affix the license plate to the second piece of the license plate mounting assembly.

In order to hinder removal of license plate 414 from second piece 474, each cavity 482 is formed to be enlarged relative to its respective nut 488 so that each bolt 489 is prevented from rotating relative to its nut 488 within cavity 482. To permit rotation of bolt 489 relative to nut 488, a plurality of biasing holes 494 are formed in second piece 474. Each biasing hole 494 is associated with and intersects a respective one of cavities 482, as best shown in FIG. 17. A locking pin 491 is associated with each biasing hole 494 and is sized to be inserted into its associated biasing hole 494.

Locking pin 491 operates to engage nut 488 and to prohibit nut 488 from freely rotating within cavity 482. This permits bolt 489 to then rotate in threaded engagement relative to nut 488 so that license plate 414 may be attached to second piece 474. Biasing holes 494 extend perpendicularly to an axis of rotation "a" of bolt 489 from a lower surface of second piece 474 so that these biasing holes 494 are inaccessible when license plate 414 and second piece 472 are pivoted into the mounted position shown in FIG. 8. In order to remove license plate 414, license plate mounting assembly 470 is removed from housing member 420. Then, each locking pin 491 is inserted into its biasing hole 494 so that bolt 489 may be removed.

A preferred construction for locking assembly 440 for use with the security box apparatus 410 is illustrated with reference to FIGS. 18 and 19. Of course, it should be readily appreciated that locking assembly 440 may also be used in conjunction with the security box apparatus according to the previously discussed embodiments of the present invention and that a variety of different locking assemblies can be used in order to effectively secure door 430 within an appropriately configured recess 422. As also discussed above, locking assembly 440 has a secured state wherein door 430 is securely latched to housing member 420 in the closed position and an unsecured state whereby door 430 is movable between the closed position and the opened position.

Figure 18:
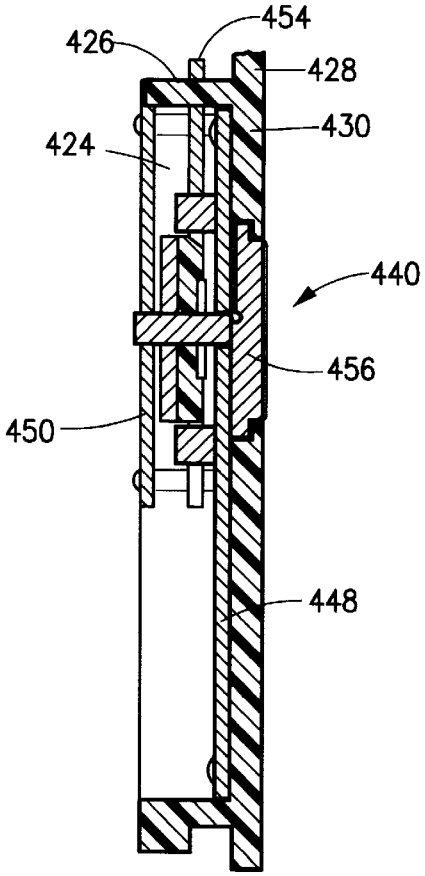
FIG. 18 is a cross-sectional side view in elevation of the locking structure associated with the door of the fifth exemplary embodiment of the present invention, with the locking structure shown in the secured state.

Locking assembly 440 has a front cover plate 448 and a rear cover plate 450 between which a majority of the working parts of locking assembly 440 are encased when in an assembled state as shown in FIG. 18. Locking assembly 440 includes an elongated latching member 452 which is operative when locking assembly 440 is in the secured state to protrude outwardly from door 430 engage an elongated slot 426 in recess 422 thereby retaining door 430 in the closed position. A plurality of tabs 454 extend upwardly from latching member 452 and these tabs 454 are sized to pass through associated slots 453 formed in door 430. Latching member 452 is further operative when locking assembly 440 is in the unsecured state to recede into housing interior 424 and become disengaged from elongated slot 426, thereby permitting door 430 to be moved between the closed position and the opened position.

Latching member 452 is operative with an array of locking elements which may include an array of dials 456, an array of first locking cylinders 460 and an array of second locking cylinders 464. Latching member 452 is operative such that when the array of locking elements, and specifically dials 456, is rotated in a selected combination of locking element positions, latching member 452 is enabled to reciprocately slide thereby enabling locking assembly 440 to move between the secured state and the unsecured state. Moreover, when the array of locking elements is rotated into a random combination of locking element positions different from a selected combination of locking of locking element positions, latching member 452 is prevented from reciprocately sliding, thereby rendering locking assembly 440 in the secured state.

The array of dials 456 are received within access ports 458 provided in door 430 so that dials 456 may be selectively rotated to a desirable combination of locking element positions. Each dial 456 includes an axial shaft 455 having both a cylindrical shaft portion 457 and a rectangular shaft portion 459. Each of the array of first locking cylinders 460 is provided with a circular bore so that independent rotate independently of their associated cylindrical shaft portion 457. Each of the cylinders in the array of second locking cylinders 464, on the other hand, has a rectangular bore so that these cylinders 464 rotate in unison with their associated dials 456. A biasing spring washer 471 is interposed between front cover plate 448 and each of locking cylinders 460 so that nubs 461 on the first array of locking cylinders 460 are urged into contact with corresponding apertures 465 formed in the array of second locking cylinders 464.

When in the assembled state, each of these cylinders in the first array of locking cylinders 460 is positioned in a respective window 462 formed in a slide bracket 466 and each of these cylinders 460 is permitted to rotate within their respective window 462.

Figure 19:
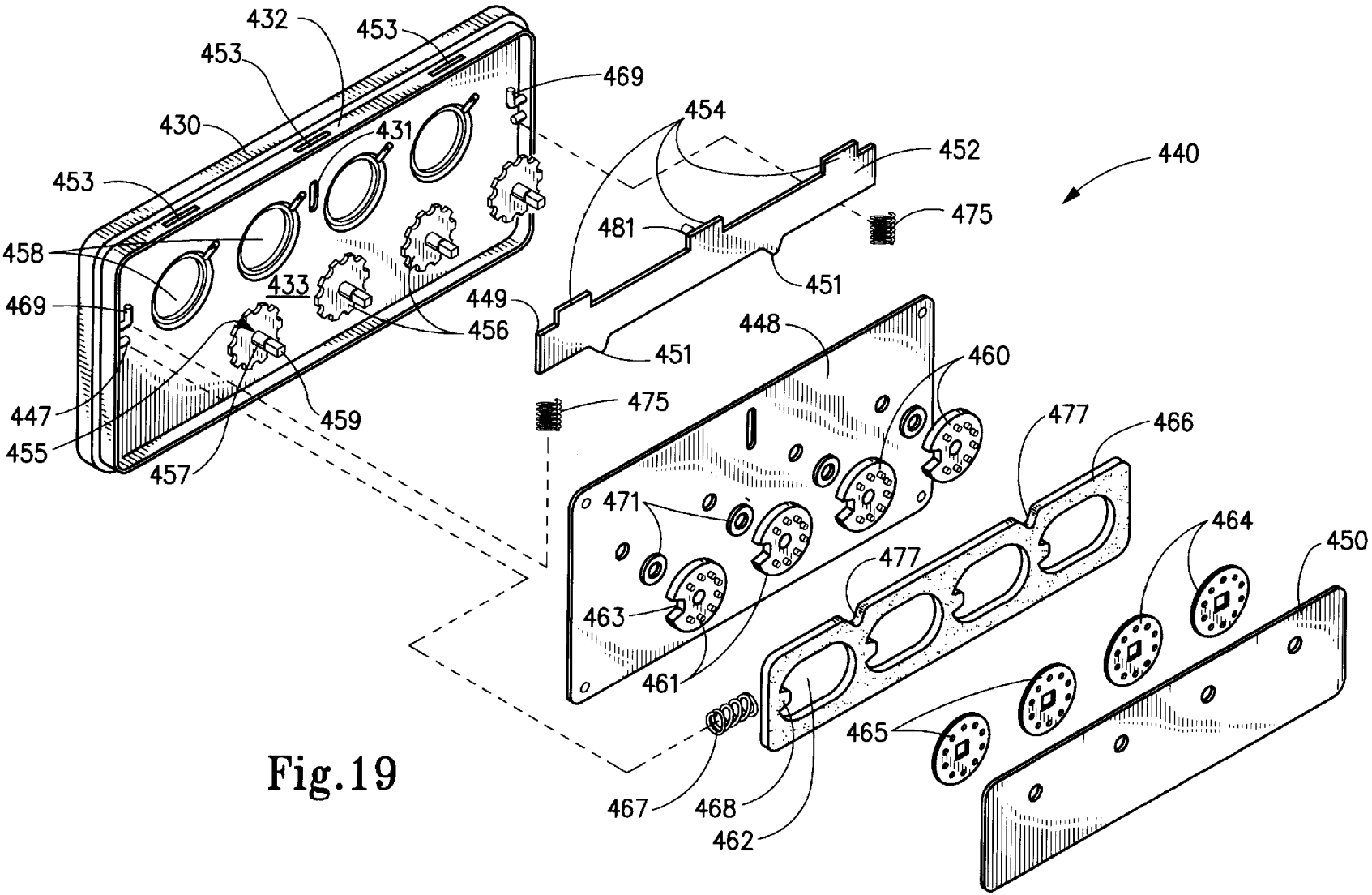
FIG. 19 is an exploded perspective view of the locking structure shown in FIG. 18.
Figure 21:
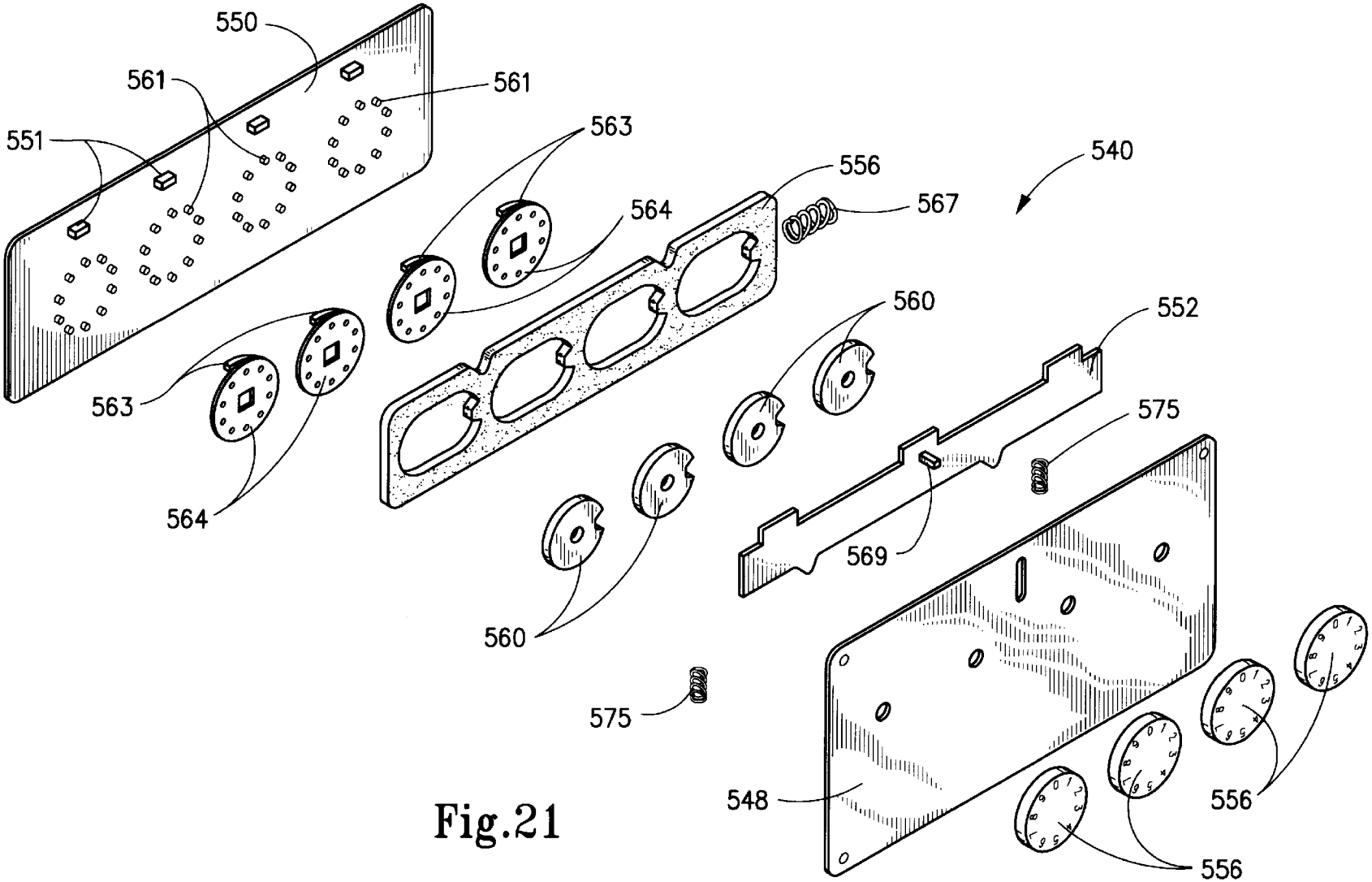
FIG. 21 is an exploded perspective view of an alternative construction for the locking structure of the present invention, with the door not shown.

A spring 467 is seated on a horizontal post 447 within door 430 and this spring resiliently biases slide bracket 466 to the right in FIG. 19. Slide bracket 466 includes a pawl 468 associated with each window 462 and spring 467 urges each of these pawls 468 into contact with their associated ones of the array of first locking cylinders 460. However, slide bracket 466 is only permitted to move to the right in FIG. 19 when the array of dials 456 is rotated into the select combination of locking element positions which operates to properly position each of the cylinders 460 so that their mouths 463 face leftward as shown in FIG. 19. If any of these cylinders in the array of first locking cylinders 460 has not assumed this position, which would be the case when the selected combination has not been dialed in by a user, then slide bracket 466 is prevented from moving toward the right and locking assembly 440 is maintained in this secured state.

However, when the proper combination of locking element positions is dialed by a user, slide bracket 466 is permitted to move to the right. This positions the pair of downwardly protruding teeth 451 disposed on latching member 452 directly above tooth grooves 477 on slide bracket 466, thereby allowing latching member 452 to be toggled in a downward direction through the manipulation of a toggle lever 481 disposed on a front surface 449 of latching member 452. This toggle lever 481 extends through both front cover plate 448 and an aperture 431 formed in the front panel 433 of door 430. Latching member 452 is resiliently biased away from slide bracket 466 by a pair of locking springs 475 which are each seated on a vertical post 469 within housing member 420.

The array of second locking elements 464 have been incorporated into the locking assembly 440 of the present invention in recognition of the fact that it may be desirous to change the selected combination of locking element positions. In order to change the selected combination, then, it is necessary that locking assembly 440 be positioned in the unsecured state with the array of dials 456 rotated into the existing selected combination of locking element positions. When this is done, slide bracket 466 operates to prevent relative movement of the array of first cylinders 460 relative to the array of dials 456. However, the array of second locking cylinders 464 are still permitted to rotate in unison with the array of dials 456 by virtue of their being mounted on the rectangular shaft portions 459 of dials 456. As such, second locking cylinders 464 are permitted to ratchet relative to first locking cylinders 460, thereby changing their relative orientation and altering the selected combination of locking element positions.

Figure 20:
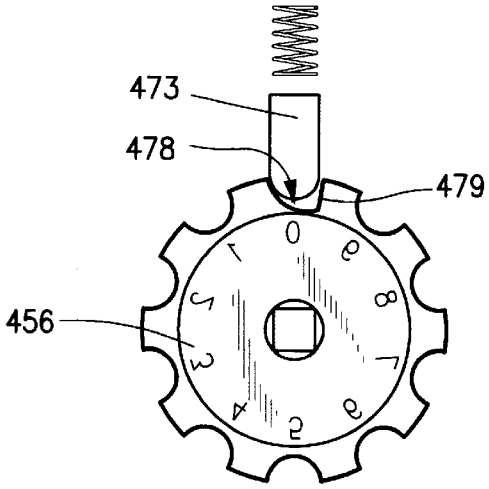
FIG. 20 is a front elevational view showing a preferred construction for a representative one of the rotatable locking dials for use with the locking assembly shown in FIGS. 18 and 19.

Another added feature of the locking assembly 440 of the present invention is the ability for a user to rotate dials 456 into the selected combination of locking element positions when the user is unable to see the indicator markings on dials 456. Such a situation might occur at nighttime. Accordingly, as shown in FIG. 20, the notch 478 associated with the "0" indicator on each dial 456 is configured differently from the remaining notches on the dial 456. Specifically, one of the notch walls 479 is flat and not curved so that as dial 456 is rotated in the counterclockwise direction in FIG. 20, a limit stop 473 prohibits rotation of dial 456 beyond the "0" indicator. Thus, when this limit stop position is reached, the user knows that dial 456 is at the "0" position and the user can then rotate dial 456 in the counterclockwise direction and ascertain (by mentally counting or audibly listening to clicks) when the desired member on dial 456 has been reached so that the selected combination of locking element positions can still be dialed.

The ability for a user to utilize the locking assembly of the present invention at nighttime can also be accomplished with a slightly different construction as illustrated in FIG. 20. Here, the majority of the components which comprise locking assembly 540 are constructed the same as those discussed above in FIGS. 19 and 20 with reference to the locking assembly 440 of the present invention. It may be seen, however, that the rear plate 550, the array of second locking elements 564 and the array of dials 556 are constructed slightly differently. Each of the second array of locking elements 564 includes a tongue 563 which is set to be indexed at the zero indicator on the array of dials 556 when the second locking cylinders are mounted to the rectangular shaft portions of these dials. Rear cover plate 550 is formed to include a shelf 551 that is associated with each of these second locking cylinders 564 so that each of dials 556 is prevented from rotating clockwise beyond the "zero" position by virtue of its associated tongue 563 engaging shelf 551. Accordingly, a user can align each of dials 556 at their zero positions and then fit dial to a selected combination of locking element positions by rotating dials 556 in a counterclockwise direction until the desired combination of positions is reached.

As may also be seen with this construction, rear cover plate 550 also includes nibs 561 so that a user can audibly listen to the clicks as the array of dials 556 are rotated. With this alternative construction of the locking assembly 540 of the present invention, then, it may be appreciated that the construction of the array of dials 556 can be simplified because it is not necessary for them to include notches as shown above in FIG. 20. Moreover, the same is true for the array of first locking cylinders 560 because now the rear cover plate 550 can be formed to include nubs 561 as opposed to forming the nubs on cylinders 560.

With the foregoing description in mind with reference to the exemplary embodiments or the present invention, it should now be understood that the security box apparatus of the present invention satisfies the need to provide a convenient and in expensive way for a person who has locked himself out of his home or vehicle to gain access therein. The security box apparatus is sized to be hidden either behind a license plate of a motor vehicle or in another inconspicuous place, such as a door or a wall. In the alternative, the security box apparatus can be mounted directly over the license of a motor vehicle and exposed for public viewing. Since the security box apparatus is designed to protect small items such as keys, the security box itself is relatively small. Where further security may be required, a frangible ampule containing a defiling fluid may be placed proximate to the protected item so that if security is breached, the ampule fractures to contaminate the protected item and render it unusable.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A security box apparatus adapted for use with a conventional license plate mounting structure of a motor vehicle which includes a plurality of spaced apart installation holes, said security box apparatus for affixing a license plate thereto and for securing a protected item, comprising:

(a) a housing member provided with a plurality of spaced apart anchoring holes extending therethrough, said anchoring holes alignable with said installation holes so that a mounting fastener may extend through aligned ones of said anchoring holes and said installation holes to securely fasten said housing member to the license plate mounting structure, said housing member including a recess formed therein to define a housing interior adapted to receive the protected item, said recess having a selected geometric configuration;

(b) a door sized and adapted to be received in the recess to enclose the interior and the protected item, said door movable from a closed position wherein said interior is enclosed thereby preventing access to the protected item and said mounting fasteners, to an opened position wherein said interior is exposed thereby permitting access to the protected item and said mounting fasteners;

(c) a locking structure associated with said door and the recess, said locking structure having a secured state wherein said door is securely latched to the recess in the closed position and an unsecured state whereby said door is movable from the closed position to the opened position; and (d) a license plate mounting assembly disposed on said housing member, said license plate mounting assembly for attaching the license plate to said housing member in a mounted position wherein the license plate conceals said door from view, said license plate mounting assembly including a first piece which is mounted to said housing member and a second piece which is removably connectable to said first piece, the license plate attachable to said second piece.

2. A security box apparatus according to claim 1 wherein said license plate mounting assembly is removably disposed on said housing member.

3. A security box apparatus according to claim 1 wherein said license plate mounting assembly includes a hinge structure for removably connecting said first and second pieces whereby when the license plate is secured to said second piece, the license plate and the second piece are operative to pivot into the mounted position relative to said first piece.

4. A security box apparatus according to claim 1 wherein said second piece includes a pair of cavities formed therein which are positioned to align with corresponding securement holes in the license plate, there being a fastening assembly associated with aligned ones of said cavities and securement holes.

5. A security box apparatus according to claim 4 wherein each said fastening assembly includes a pair of cooperative fasteners in the form of a nut and bolt, each said nut sized to fit within a respective one of said cavities and each said bolt sized and adapted to extend through the aligned ones of said cavities and said securement holes to threadedly engage a respective said nut thereby to attach the license plate to said second piece.

6. A security box apparatus according to claim 5 wherein each said cavity is enlarged relative to the cavity's respective said nut so that each said bolt is prevented from rotating relative to its associated said nut within said cavity.

7. A security box apparatus according to claim 6 including a plurality of biasing holes formed in said second piece, there being one of said plurality of biasing holes associated with and intersecting each said cavity, each said fastening assembly further including a locking pin which is sized to be inserted into an associated one of said biasing hole, each said locking pin operative to engage a said nut and to prohibit said nut from freely rotating within its respective said cavity, thereby permitting each said bolt to rotate in threaded engagement relative to its respective said nut to attach the license plate to said second piece.

8. A security box apparatus according to claim 7 wherein said biasing holes are positioned along said second piece so that they are inaccessible when said license plate and said second piece are pivoted into the mounted position.

9. A security box apparatus adapted for use with a conventional license plate mounting structure of a motor vehicle which includes a plurality of spaced apart installation holes, said security box apparatus for affixing a license plate thereto and for securing a protected item, comprising:

(a) a housing member provided with a plurality of spaced apart anchoring holes extending therethrough, said anchoring holes alignable with said installation holes so that a mounting fastener may extend through aligned ones of said anchoring holes and said installation holes to securely fasten said housing member to the license plate mounting structure, said housing member including a recess formed therein to define a housing interior adapted to receive the protected item, said recess having a selected geometric configuration;

(b) a door sized and adapted to be received in the recess to enclose the interior and the protected item, said door movable from a closed position wherein said interior is enclosed thereby preventing access to the protected item and said mounting fasteners, to an opened position wherein said interior is exposed thereby permitting access to the protected item and said mounting fasteners;

(c) a locking structure associated with said door and the recess, said locking structure having a secured state wherein said door is securely latched to the recess in the closed position and an unsecured state whereby said door is movable from the closed position to the opened position; and (d) a license plate mounting assembly disposed on said housing member, said license plate mounting assembly for attaching the license plate to said housing member in a mounted position wherein the license plate conceals said door from view, said license plate mounting assembly operative to be removably disposed within the recess, said recess sized to accommodate both the license plate mounting assembly and said door in a close fitted relationship whereby when said door is in the closed position, said door prohibits removal of said license plate mounting assembly from the recess.

10. A security box apparatus according to claim 9 wherein the recess includes a rail and the license plate mounting assembly includes a channel formed therein which is adapted to slidably and interlockingly engage said rail so that the license plate mounting assembly may be inserted into and removed from the recess.

11. A security box apparatus according to claim 10 wherein said license plate mounting assembly includes a first piece which is provided with said channel and a second piece which is removably connectable to said first piece, said second piece constructed so that the license plate is attachable thereto.

* * * * *